United States Patent [19]

Tarumi et al.

[11] 4,179,601

[45] Dec. 18, 1979

[54] FIXING APPARATUS FOR ELECTROPHOTOGRAPHIC COPYING MACHINE

[75] Inventors: Noriyoshi Tarumi; Kenji Ueno, both of Hachioji; Hirofumi Sakaguchi, Akigawa, all of Japan

[73] Assignee: Konishiroku Photo Industry Co., Ltd., Tokyo, Japan

[21] Appl. No.: 911,345

[22] Filed: Jun. 1, 1978

[30] Foreign Application Priority Data

Jun. 7, 1977 [JP] Japan ..... 52-66273

[51] Int. Cl.[2] ..... H05B 1/00

[52] U.S. Cl. ..... 219/216; 219/388; 219/469

[58] Field of Search ..... 219/216, 469–471, 219/388; 355/3 FU; 432/60, 228; 252/511, 513, 514, 518; 100/93 RP

[56] References Cited

U.S. PATENT DOCUMENTS

| | | | |
|---|---|---|---|
| 3,235,772 | 2/1966 | Gurin | 252/518 X |
| 3,809,854 | 5/1974 | Sanders | 219/469 X |

*Primary Examiner*—C. L. Albritton

*Attorney, Agent, or Firm*—James E. Nilles

[57] ABSTRACT

A roller type fixing apparatus for an electrophotographic copying machine comprising a fixing roller, a pressing roller disposed to confront and have contact with said fixing roller and a mechanism for rotating said fixing roller and press roller. At least one of said fixing roller and press roller has a peripheral surface layer portion composed of a resinous material and a low electric resistance powder incorporated therein and said peripheral surface layer portion is electrically grounded.

7 Claims, 2 Drawing Figures

FIXING APPARATUS FOR ELECTROPHOTOGRAPHIC COPYING MACHINE

Figure 1:
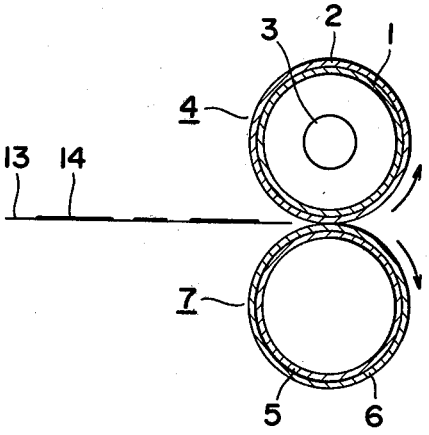

The present invention relates to a roller fixing apparatus for an electrophotographic copying machine.

In an electrophotographic copying apparatus utilizing the electrophotography, a roller fixing apparatus is ordinarily used for fixing a toner image formed on a copying paper such as a photosensitive paper, a transfer paper or the like.

This roller fixing apparatus comprises a fixing roller provided with a heating mechanism, a press roller disposed to confront and have contact with said fixing roller, and a rotating and driving mechanism for rotating said rollers in the confronting and contacting state, and in this roller fixing apparatus, a copying paper having a toner image formed on the surface thereof is fed between the two rollers to that the toner image-carrying surface is caused to fall in contact with the peripheral surface of the fixing roller, and the toner is heated and fused while the copying paper is thus fed by the rollers and the toner image is fixed.

In the roller fixing apparatus, in order to perform the foregoing fixing operation smoothly, the conventional fixing roller or press roller is constructed by forming a layer of an elastic material such as a silicone rubber or a layer of a coating composed of Teflon or the like on the peripheral surface of a metal substrate having a cylindrical configuration, so that the entire surface of a copying paper is caused to fall in contact with the fixing roller with a predetermined uniform pressing force and discharge of the copying paper from between both the rollers is accomplished smoothly and easily.

In these rollers, however, the peripheral surface layer portion composed of the above-mentioned material is electrically insulating and the roller surface is electrically charged by friction. This electric charging is caused by passage of copying papers through between both the rollers and by the fact that copying papers fed to the rollers have already been electrically charged through the charge quantity is not so large. In the actual operation, the rollers are often charged until several KV potential. When the respective rollers are thus electrically charged, various troubles or disadvantages as described below are caused.

(1) The offset phenomenon is readily caused to occur. By the term "offset phenomenon" is meant a phenomenon in which a part of the toner on a copying paper is caused to adhere to the fixing roller and this adhering toner is transferred on the copying paper with rotation of the roller. By this offset phenomenon, the image quality of a reproduced picture is drastically degraded and the fixing roller is extremely contaminated. When the parting property of the fixing roller is insufficient or when the heating temperature is high, the time for which the toner of the copying paper electrostatically attracted to the fixing roller is kept in contact with the fixing roller is prolonged and occurrence of the offset phenomenon is conspicuous.

(2) Winding of the copying paper around the roller is readily caused. The copying paper which has passed through between the fixing and press rollers is wound around the peripheral surface of the fixing roller or press roller by the electrostatic attraction thereof, and intended exhaust of the copying paper cannot be accomplished smoothly. Especially when the parting property of the fixing roller is insufficient or the heating temperature is low, occurrence of this undersirable phenomenon is accelerated by the adhesive force of the toner.

(3) The copying paper to be exhausted from the roller fixing apparatus is highly electrically charged and it is very difficult to exhaust copying papers smoothly in a continuous manner. Namely, no good slip is attained among papers and exhaust of the copying papers into a paper-receiving saucer is inhibited. Further, there is a risk of an electric shock when exhausted copying papers are handled.

(4) The toner image is repelled by the electrostatic force of the fixing roller or press roller just before the fixation, and therefore, bleeding is caused in a reproduced picture and the resolving ability of the copied image is lowered.

Removal of the charge on an exhausted copying paper by charge removing means is effective for preventing occurrence of the above trouble (3), but this means is not effective at all for eliminating other troubles.

It is therefore a primary object of the present invention to provide a roller fixing apparatus for an electrocopying machine, in which the foregoing defects can be completely eliminated and toner images can be fixed very smoothly without occurrence of any trouble.

In accordance with the present invention, there is provided a roller type fixing apparatus for an electrophotographic copying machine, which comprises a fixing roller, a pressing roller disposed to confront and have contact with said fixing roller and a mechanism for rotating and driving said fixing roller and press roller, wherein at least one of said fixing roller and press roller has a peripheral surface layer portion composed of a resinous material and a low electric resistance substance powder incorporated therein and said peripheral surface layer portion is electrically grounded.

Figure 2:
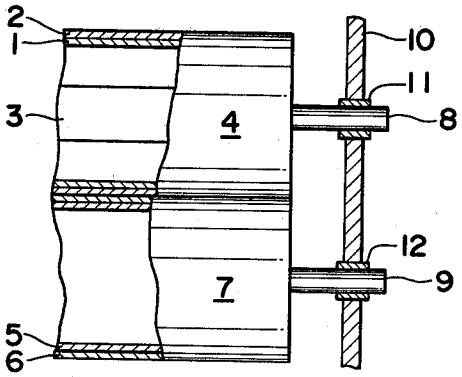

Other objects and features of the present invention will be apparent from the following description taken together with the accompanying drawing, in which:

FIG. 1 is a longitudinal sectional side view illustrating the main part of the roller fixing apparatus of the present invention for an electrophotographic copying machine; and FIG. 2 is a front view illustrating the main part of the roller fixing apparatus of the present invention shown in FIG. 1.

Referring to FIGS. 1 and 2, in the roller fixing apparatus of the present invention, for example, a fixing surface layer portion 2 is formed on the peripheral surface of a substrate 1 consisting of an aluminum drum having an outer diameter of 40 mm, a thickness of 3 mm and a length of 300 mm. This fixing surface layer portion 2 comprises a flourine resinous material such as a tetrafluoroethylene polymer or a tetrafluoroethylene/-hexafluoropropylene copolymer and carbon black powder and titanium dioxide powder incorporated and dispersed in said resinous material, and the fixing surface layer portion 2 has such a low volume resistivity as not exceeding $10^{10}$ Ω-cm. Further, a heating mechanism 3 consisting of, for example, an infrared lamp is disposed in the internal space of the substrate 1. Thus, a fixing roller 4 is constructed. A press roller 7 is constructed by forming a pressing surface layer portion 6 on the peripheral surface of a substrate 5 similar to the above-mentioned substrate 1. This pressing surface layer portion 6 is composed of an elastic resinous material such as a silicone rubber and carbon black powder and titanium dioxide powder incorporated and dispersed in said elastic resinous material, and the pressing surface layer portion 6 has such a low volume resistivity as not exceeding $10^{10}$ Ω-cm. Rotation metal shafts 8 and 9 connected to the substrates 1 and 5, respectively, are supported by bearings 11 and 12 fixed to a machine frame 10 of an electrophotographic copying machine and composed of an electrically conductive material, so that the peripheral surfaces of the fixing roller 4 and press roller 7 are brought into contact with each other under a predetermined pressure. Furthermore, a rotating and driving mechanism (not shown) is disposed to rotate said fixing roller 4 and press roller 7 in this confronting and contacting state.

In FIG. 1, reference numerals 13 and 14 represent a transfer paper fed to the roller type fixing apparatus and a toner image formed thereon, respectively.

The fixing surface layer portion 2 or pressing surface layer portion 6 is formed by incorporating and dispersing carbon black powder and titanium dioxide powder into a solution or emulsion of the resinous material constituting the surface layer portion, coating the resulting dispersion on the peripheral surface of the substrate 1 or 5, and drying and, if desired, heat-treating the coating.

In the roller fixing apparatus of the present invention for an electrophotographic copying machine, each of the fixing surface layer portion 2 constituting the peripheral surface of the fixing roller 4 and the pressing surface layer portion 6 constituting the peripheral surface of the pressing roller 7 has a very low electric resistance, and further, these surface layer portions 2 and 6 are electrically grounded to the machine frame 10 of the electrocopying machine through the substrates 1 and 5, the rotation shafts 8 and 9 and the bearings 11 and 12, respectively. Therefore, these surface layer portions 2 and 6 are hardly charged. More specifically, since both the surface layer portions 2 and 6 are kept in the non-charged state, even if an introduced copying paper is electrically charged, the charge on the copying paper is eliminated by the surface layer portions, and even if the copying paper 13 passes through between both rollers 4 and 7, the copying paper 13 and the rollers 4 and 7 are prevented from being electrically charged. Accordingly, all the troubles or disadvantages caused by charging of the respective rollers 4 and 7 and the copying paper 13 can be effectively eliminated. More specifically, the offset phenomenon or winding of the copying paper around the roller 4 or 7 is not caused at all, and the copying paper 13 can be smoothly exhausted onto a copying paper receiving saucer and there is no risk of an electric shock even if a worker touches the exhausted copying paper. Moreover, since bleeding is not caused in a fixed toner image, reduction of the resolving power can be effectively prevented. Thus, according to the present invention, the fixing operation can be accomplished very smoothly in good conditions.

Moreover, the surface of the surface layer portion 2 of the fixing roller 4 is not contaminated, and even if contaminated, the degree of the contamination is very low. Still further, charge removing means need not be disposed to remove charges from copying papers.

The foregoing effects are attained only by using substantially electrically unchargeable materials having a low electric resistance for the surface layer portions 2 and 6. Optimum results can be obtained if these materials are electrically conductive and are not charged at all, but satisfactory results can be obtained when these materials have such a low volume resistivity as will prevent charging practically. Namely, if the volume resistivity is lower than $10^{10}$ Ω-cm, preferably lower than $10^{8}$ Ω-cm, satisfactory results can be obtained.

In the roller fixing apparatus of the present invention, since no electrostatic attractive force is imposed on each of the rollers 4 and 7 as described hereinbefore, the parting property of each roller is improved accordingly. However, it is preferred that the parting property of the fixing roller 4 be as high as possible. From this viewpoint, it is preferred to use a tetrafluoroethylene polymer or tetrafluoroethylene/hexafluoropropylene copolymer as the resinous material of the fixing surface layer portion 2. When carbon black powder is incorporated into a silicone rubber, the parting property is degraded. Accordingly, the use of such silicone rubber as the resinous material of the fixing surface layer portion 2 is not preferred. In contrast, such a high parting property is not required for the pressing surface layer portion 6 and therefore, a silicone rubber can be used as the resinous material for the pressing surface layer portion 6. It is preferred that the toner including a surface releasing agent, having said surface releasing property and offset preventing property itself, is used to the roller type fixing apparatus without employing a surface releasing agent such as silicone oil on the surface of the fixing roller. Said toner is already described, for example, at the Japanese laid open patent applications Nos. 49-65,231, 49-65,232 and 50-134,652.

In each of the fixing surface layer portion 2 of the fixing roller 4 and the pressing surface layer portion 6 of the press roller 7, particles of the low electric resistance powdery substance are brought in contact with one another in the resinous material, whereby the resistivity is reduced and non-chargeability is attained. From various viewpoints, carbon black powder is preferred as the low electric resistance powdery substance, but powders of other low electric resistance substances such as metal powders, other electrically conductive powders, and powders of titanium oxide, zinc oxide and other inorganic compound semiconductors can also be used. If only carbon black powder is incorporated in the resinous material, a desirable low volume resistivity can be obtained, but in this case, a considerably large quantity of carbon black powder should be incorporated and hence, there is a risk of reduction of the parting property in the resulting surface layer portion 2 or 6. If a powder of an inorganic compound semiconductor such as titanium dioxide, zinc oxide or tin oxide is incorporated in the resinous material in combination with carbon black powder, the amount of carbon black powder can be reduced and a sufficient parting property can be maintained in the resulting surface layer portion 2 or 6. One of reasons is considered to be that particles of the inorganic compound semiconductor have a relatively large size. Further, if a powder of the inorganic compound semiconductor is incorporated in the resinous material, it is expected that the surface smoothness of the resulting surface layer portion 6 can be improved. Moreover, since a metal oxide semiconductor such as titanium dioxide or zinc oxide is white, if it is incorporated together with carbon black, gray surface layer portions 2 and 6 can be obtained, and there is attained another advantage that the surface contamination can readily be detected.

The present invention has been described in detail by reference to one embodiment thereof. Of course, various changes and modifications can be made in the present invention. For example, if one of the fixing surface layer portion 2 and pressing surface layer portion 6 is composed of an elastic material, the other surface layer portion may be composed of a non-elastic material. When the surface layer portion of one of the fixing roller 4 and the press roller 7 is rendered electrically non-chargeable, even if the other surface layer portion is electrically chargeable, the intended effects of the present invention can be attained, though the degree is lower than in the case where both the surface layer portions are rendered electrically non-chargeable. For example, if only the surface layer portion of the fixing roller is rendered non-chargeable according to the present invention, when copying papers are continuously passed, charges are gradually accumulated and troubles are caused, but if copying papers are passed at certain time intervals, charges accumulated on the press roller are allowed to escape from the non-chargeable surface layer portion of the fixing roller, and occurrence of troubles by accumulation of charges can be prevented practically satisfactorily.

The surface layer portion 2 or 6 to be rendered non-chargeable should be electrically grounded, and various means can be used for this purpose. It is rational to ground the surface layer portions to the machine frame through the substrates 1 and 5, rotation shafts 8 and 9 and bearings 11 and 12 as in the foregoing embodiment. Of course, materials of these members are not limited to metallic materials, but they may be composed of other electrically conductive materials.

Experiments conducted for confirming the effects of the present invention will now be described.

A roller fixing apparatus I including non-chargeable surface layer portions in both the fixing roller and the press roller and constructed according to the foregoing embodiment, a roller fixing apparatus II having the same structure as that of the apparatus I except that the surface layer portion of the press roller did not contain the electrically conductive powder and titanium dioxide, a roller fixing apparatus III having the same structure as that of the apparatus I except that the surface layer portion of the press roller did not contain the electrically conductive powder and titanium oxide, and a roller fixing apparatus IV having the same structure as that of the fixing apparatus I except that the surface layer portions of both the fixing and press rollers did not contain the electrically conductive powder and titanium dioxide were prepared. Each of these fixing apparatuses was separately built in an electrophotographic copying machine (U-Bix 2000R manufactured by Konishiroku Photo Industry Co., Ltd.) while dismounting charge removing means inherent of this machine therefrom. By using B-4 size transfer papers having a unit weight of 55 Kg, the continuous copying test was carried out at a fixing temperature of 180° C. under a roller pressure of 50 Kg. Charge quantities of 50th and 100th copying papers were measured. With respect to each copying paper, the measurement was conducted on the central part C, the left side HL of the leading part, the right side HR of the leading part, the left side TL of the tail part and the right side TR of the tail part. The measurement was carried out in an atmosphere maintained at a temperature of 10° C. and a relative humidity of 20% by using an electrometer. Obtained results are shown in the following Table.

Table

| Fixing Apparatus | Multi Copying Paper Number | Charge Quantities (V) at Respective Points | | | | |
|---|---|---|---|---|---|---|
| | | C | HL | HR | TL | TR |
| I | 50 | +13 | +185 | −19 | +420 | +20 |
| I | 100 | −46 | +500 | −210 | +500 | −46 |
| II | 50 | +410 | +920 | +320 | +830 | +120 |
| II | 100 | +2200 | +3000* | +2200* | +3000* | +800 |
| III | 50 | −1700* | −1800* | −2500* | −1500* | −800 |
| III | 100 | −3000* | −3000* | −3000* | −3000* | −2200* |
| IV | 50 | +2600* | +3000* | +3000* | +3000* | +2400* |
| IV | 100 | +3000* | +3000* | +3000* | +3000* | +3000* |

Note
*: the actual value was larger than the value indicated.

As will be apparent from the results shown in the above Table, in the roller fixing apparatus of the present invention, the charge quantity of a discharged copying paper can be remarkably reduced and the above-mentioned various effects can be attained assuredly. It will also be apparent that prominent effects can be attained if the surface layer portions of both the rollers are rendered non-chargeable as in the fixing apparatus I and that if the surface layer portion of one roller is rendered non-chargeable as in the fixing apparatuses II and III, the effects can be attained to some extent.

As will be apparent from the foregoing illustration, according to the roller fixing apparatus of the present invention, accumulation charges on the rollers and copying papers can be prevented by a very simple structure and occurrence of various troubles owing to accumulation of charges can be completely prevented. Therefore, according to the roller fixing apparatus of the present invention, the fixing operation can be performed very smoothly in good conditions and the capacity of an electrophotographic copying machine can be remarkably improved. Thus, various great advantages can be attained by the present invention.

What is claimed is:

1. A fixing apparatus for an electrophotographic copying machine which apparatus comprises a rotatable heated fixing roller having a resinous surface layer comprising a resinous fluorine material and carbon black.

2. A fixing apparatus as set forth in claim 1 wherein the fixing apparatus further comprises a press roller being contacted with the fixing roller with pressure at least during copying operation.

3. A fixing apparatus as set forth in claim 1 wherein the resinous fluorine material is a tetrafluoroethylene polymer.

4. A fixing apparatus as set forth in claim 1 wherein the resinous fluorine material is a copolymer of tetrafluoroethylene and hexafluoropropylene.

5. A fixing apparatus as set forth in claim 1 wherein the resinous fluorine material is a copolymer of tetrafluoroethylene and perfluoro-alkoxiethylene.

6. A fixing apparatus as set forth in claim 1 wherein the resinous surface layer further comprises titanium dioxide.

7. An electrophotographic copying machine having a fixing apparatus which comprises a pair of rollers for fixing toner images onto a recording sheet, one of which rollers is a heated fixing roller having a resinous surface layer comprising a resinous fluorine material and carbon black while the other being contacted to the fixing roller with pressure, the toner comprising polypropylen of low molecular weight.

* * * * *